US009513061B2

(12) United States Patent
Choi et al.

(10) Patent No.: US 9,513,061 B2
(45) Date of Patent: Dec. 6, 2016

(54) DUAL PIPE FOR HEAT EXCHANGE

(71) Applicant: HS R & A Co., Ltd., Yangsan-si, Gyeongsangnam-do (KR)

(72) Inventors: Jaehyeok Choi, Yangsan-si (KR); Gukhyun Kim, Yangsan-si (KR); Deokhyun Lim, Yangsan-si (KR); Youngjun Kim, Yangsan-si (KR)

(73) Assignee: HS R & A Co., Ltd., Gyeongsangnam-do (KR)

( * ) Notice: Subject to any disclaimer, the term of this patent is extended or adjusted under 35 U.S.C. 154(b) by 291 days.

(21) Appl. No.: 14/019,138

(22) Filed: Sep. 5, 2013

(65) Prior Publication Data

US 2014/0060786 A1 Mar. 6, 2014

(30) Foreign Application Priority Data

Sep. 5, 2012 (KR) ..... 10-2012-0098149

(51) Int. Cl.

*F28D 7/02* (2006.01)
*F28F 9/02* (2006.01)
*F28D 7/10* (2006.01)

(52) U.S. Cl.

CPC ..... *F28D 7/024* (2013.01); *F28D 7/10* (2013.01); *F28F 9/02* (2013.01)

(58) Field of Classification Search

CPC ..... F28D 7/10; F28D 7/024; F28D 7/028; F28F 9/02
USPC ..... 165/156, 163
See application file for complete search history.

(56) References Cited

U.S. PATENT DOCUMENTS

| | | | | |
|---|---|---|---|---|
| 3,802,499 | A * | 4/1974 | Garcea | 165/163 |
| 6,298,687 | B1 * | 10/2001 | Dienhart et al. | 62/513 |
| 6,390,137 | B1 | 5/2002 | Ewald et al. | |
| 7,661,460 | B1 * | 2/2010 | Cowans et al. | 165/64 |
| 2001/0020786 | A1 | 9/2001 | Takamatsu et al. | |
| 2004/0178627 | A1 | 9/2004 | Takasaki | |
| 2004/0188071 | A1 * | 9/2004 | Wilson et al. | 165/163 |

(Continued)

FOREIGN PATENT DOCUMENTS

| | | |
|---|---|---|
| CN | 101929768 | 12/2010 |
| EP | 1070642 A2 | 1/2001 |

(Continued)

OTHER PUBLICATIONS

European Search Report for EP13181460.0 (mailed Jul. 24, 2014).

(Continued)

*Primary Examiner* — Tho V Duong
(74) *Attorney, Agent, or Firm* — Klarquist Sparkman, LLP

(57) ABSTRACT

A dual pipe and a heat exchanger comprises: an outer pipe formed separately from the inner pipe to house the inner pipe therein; and a connector coupled to the inner pipe and the outer pipe. The connector includes: an outer pipe connection portion for housing an end portion of the outer pipe therein; a fastening groove; a stopper; and a through hole. The inner pipe is housed at the inside of the outer pipe, and a coil portion is formed in a portion positioned at the inside of the outer pipe. A portion extended from the coil portion is extended from the inside to the outside of the connector through a through hole of the connector. An outermost portion of the coil portion line contacts with an inner circumferential surface of the outer pipe.

3 Claims, 11 Drawing Sheets

(56) References Cited

U.S. PATENT DOCUMENTS

| | | | | |
|---|---|---|---|---|
| 2004/0227345 | A1* | 11/2004 | Okamoto | F16L 47/04 285/331 |
| 2006/0086492 | A1 | 4/2006 | Kato | |
| 2010/0018246 | A1* | 1/2010 | Wolfe et al. | 62/513 |
| 2010/0181045 | A1* | 7/2010 | Bognarne Fejes | 165/67 |
| 2012/0325450 | A1 | 12/2012 | Mimitz et al. | |

FOREIGN PATENT DOCUMENTS

| | | | |
|---|---|---|---|
| EP | 2199721 | | 6/2010 |
| JP | 54-142127 | | 11/1979 |
| JP | 2001-336833 | A | 12/2001 |
| JP | 2002-228072 | A | 8/2002 |
| JP | 2004-340304 | A | 12/2004 |
| JP | 2004-340512 | A | 12/2004 |
| JP | 2005-061771 | A | 3/2005 |
| JP | 2005-147567 | A | 6/2005 |
| JP | 2005-345034 | A | 12/2005 |
| JP | 2006-003071 | A | 1/2006 |
| JP | 2006-153419 | A | 6/2006 |
| JP | 2007-107581 | A | 4/2007 |
| JP | 2007-177872 | A | 7/2007 |
| JP | 2008-164245 | A | 7/2008 |
| JP | 2008-209074 | A | 9/2008 |
| JP | 3157975 | U | 2/2010 |
| JP | 2010-096225 | A | 4/2010 |
| KR | 20110052889 | | 5/2011 |
| KR | 10-1166806 | | 7/2012 |
| WO | WO2007/013439 | | 2/2007 |
| WO | WO2010/051333 | | 5/2010 |
| WO | WO2012/024606 | A1 | 2/2012 |

OTHER PUBLICATIONS

Office Action for JP2013-175821 with translation (mailed Nov. 21, 2014).

Chinese Office action for corresponding Chinese Pat. App. No. 201310394888.7 and its English translation, 8 pp. (Jul. 22, 2015).

Japanese Office action for corresponding Japanese Pat. App. No. 2013-175821 and its English translation, 9 pp. (Aug. 7, 2015).

* cited by examiner

DUAL PIPE FOR HEAT EXCHANGE

CROSS REFERENCE TO RELATED APPLICATION

This application claims the benefit under 35 U.S.C. §119 (a) of a Korean patent application filed on Sep. 5, 2012 in the Korean Intellectual Property Office and assigned Serial No. 10-2012-0098149, the entire disclosure of which is hereby incorporated by reference.

BACKGROUND

The present invention relates to a dual pipe and a heat exchanger having the same, and more particularly, to a dual pipe and a heat exchanger having the same that can improve heat exchange efficiency of a heat exchanger by providing a dual pipe structure having an excellent performance in thermal conductivity.

An air conditioning apparatus for a vehicle is installed at the vehicle to air condition the interior of the vehicle by ventilating cold wind to the interior of the vehicle.

A general air conditioning system of such an air-conditioning apparatus performs a refrigeration cycle formed by connecting a compressor for compressing and transmitting a refrigerant, a condenser for condensing a refrigerant of a high pressure transmitted from the compressor, an expansion valve for decompressing a liquefied refrigerant by being condensed at the condenser, and an evaporator for cooling air ejected to the interior with an endothermic reaction by an evaporative latent heat of the refrigerant by evaporating the liquid refrigerant by heat exchange of the liquid refrigerant of a low pressure decompressed by the expansion valve with air ventilated to the interior side of the vehicle to a refrigerant pipe and air-conditions the interior of the vehicle through a refrigerant circulation cycle.

In order to enhance an air conditioning performance of the air-conditioning apparatus, a liquid refrigerant of a high temperature and a high pressure expanded by the expansion valve is supercooled, and as an apparatus that can appropriately adjust a superheat degree of a refrigerant exhausted from the evaporator is necessary, and thus a recently developed cooling system installs and uses a predetermined internal heat exchanger at the expansion valve inhalation side and the compressor inhalation side. Such an internal heat exchanger has a dual pipe structure formed with an inner pipe between a compression pipe in the evaporator and connected an outer pipe connected between the condenser and the expansion valve.

At the inner pipe, a refrigerant of a gas state of a low temperature and a low pressure flows, and at the outer pipe, a refrigerant of a liquid state of a high temperature and a high pressure flows, and the refrigerants flow in an opposite direction and exchange a heat. That is, by exchanging a heat of a liquid refrigerant of a high temperature and a high pressure injected into the expansion valve and a gap refrigerant of a low temperature and a low pressure exhausted from the evaporator, a temperature can be appropriately adjusted.

When such an internal heat exchanger has a large heat transfer rate, the internal heat exchanger has good heat exchange efficiency and thus the heat transfer rate greatly depends on a structure of the dual pipe. Further, in EU, in order to limit a greenhouse gas from releasing to air, a hydro-fluoro-carbon (HFC)-based 134a (R134a) refrigerant, which is a presently using global warming material will be replaced with a hydro-fluoro-olefin (HFO)-based 1234yf refrigerant, which is a low warming material, and a performance of a 1234yf refrigerant to be replaced in the future is deteriorated by about 15%, compared with a present refrigerant, i.e., R134a in an existing heat exchanger.

In order to improve an insufficient refrigerant performance, an air-conditioning apparatus such as a compressor, evaporator, and condenser should be improved and for this, much economic burdens occur.

Therefore, in order to improve efficiency and performance of an air-conditioner system for a vehicle according to a refrigerant change, a method of improving performance deterioration of a heat exchanger is requested.

SUMMARY

The present invention has been made in view of the above problems, and provides a heat exchanger that can improve cooling efficiency of a cooling system by improving heat exchange efficiency of a heat exchanger by a dual pipe structure.

In accordance with an aspect of the present invention, a dual pipe for heat exchange includes: an inner pipe; an outer pipe formed separately from the inner pipe to house the inner pipe therein; and a connector coupled to the inner pipe and the outer pipe. The connector includes: an outer pipe connection portion for housing an end portion of the outer pipe therein; a fastening groove for fastening a supply pipe of a fluid supplied to a flow path formed between the outer pipe and the inner pipe; a stopper formed at an inner circumferential surface of the outer pipe connection portion; and a through hole having an inner circumferential surface contacting with an outer circumferential surface of the inner pipe.

An inner diameter of the outer pipe connection portion is the same as that of the outer pipe, the inner pipe is housed at the inside of the outer pipe, a coil portion is formed in a portion positioned at the inside of the outer pipe, a portion extended from the coil portion is extended from the inside to the outside of the connector through a through hole of the connector, and an outermost portion of the coil portion line contacts with an inner circumferential surface of the outer pipe.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Figure 1:
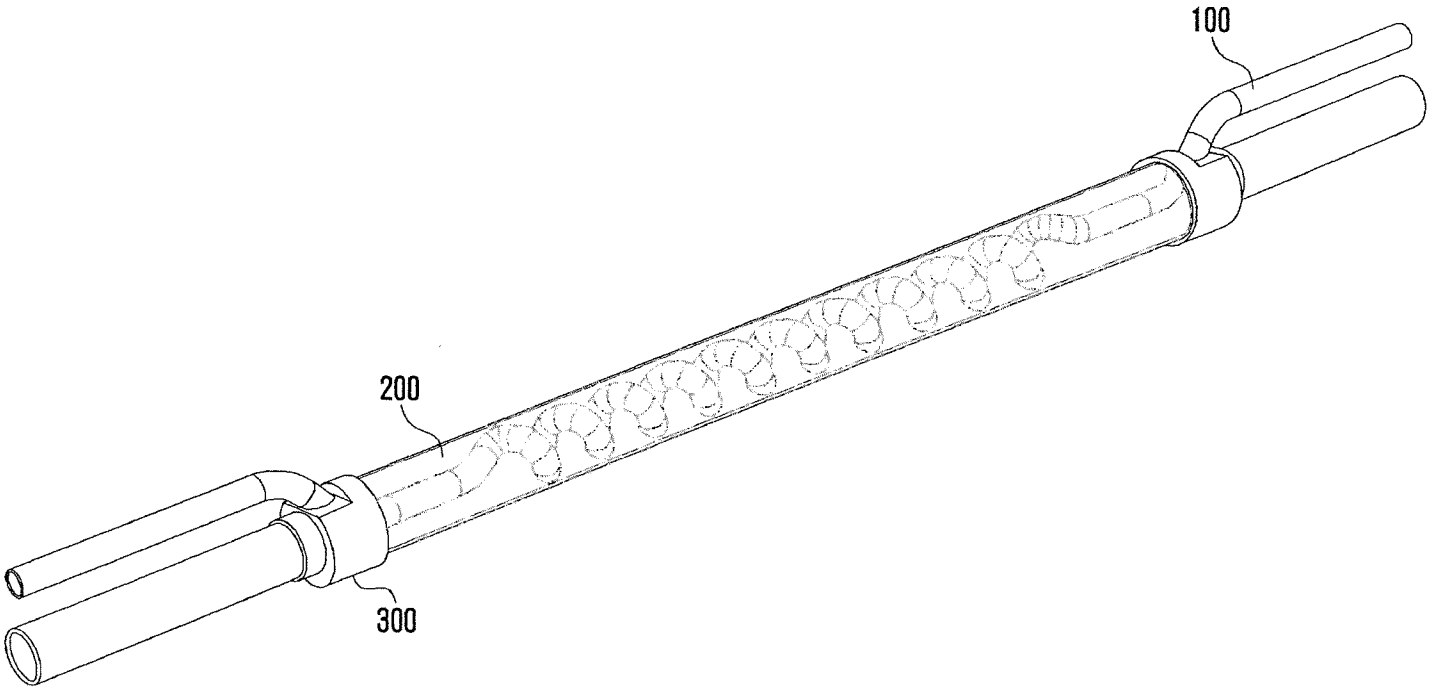
FIG. 1 is a perspective view illustrating a dual pipe for heat exchange according to an exemplary embodiment of the present invention.

Hereinafter, exemplary embodiments of the present invention are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present invention.

FIG. 1 is a perspective view illustrating a dual pipe for heat exchange according to an exemplary embodiment of the present invention.

Referring to FIG. 1, the dual pipe of the present exemplary embodiment includes an inner pipe 100, outer pipe 200, and connector 300.

It is general that in an outer pipe flow channel formed between the outer pipe 200 and the inner pipe 100, a refrigerant of a liquid state of a high temperature and a high pressure flows, and in an inner pipe flow channel formed in the inner pipe 100, a refrigerant of a gas state of a low temperature and a low pressure flows. The both fluids flow in an opposite direction and exchange a heat in an opposite type.

All of the outer pipe 200, inner pipe 100, and connector 300 have a section shape of a circular shape, but a section shape of the outer pipe 200, inner pipe 100, and connector 300 is not limit thereto and can be formed in various polygonal shapes.

First Exemplary Embodiment

Figure 2:
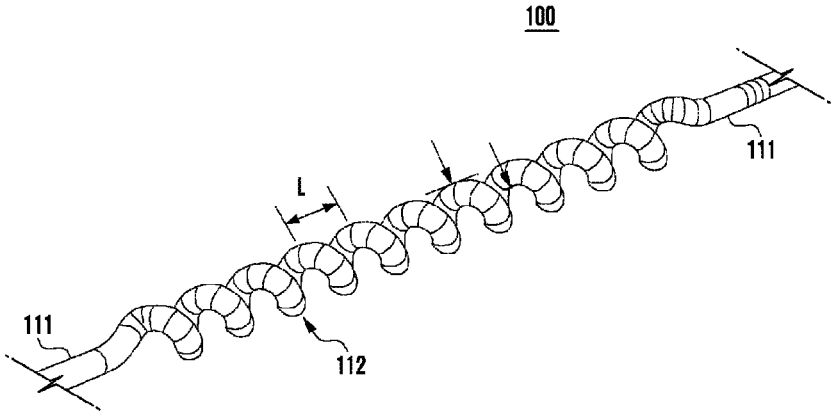
FIG. 2 is a perspective view illustrating a coil type inner pipe according to a first exemplary embodiment of the present invention.
Figure 3A:
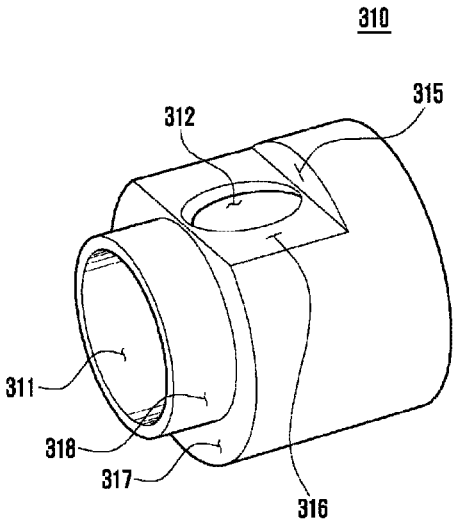
FIG. 3A is a perspective view illustrating a connector according to a first exemplary embodiment of the present invention.
Figure 3B:
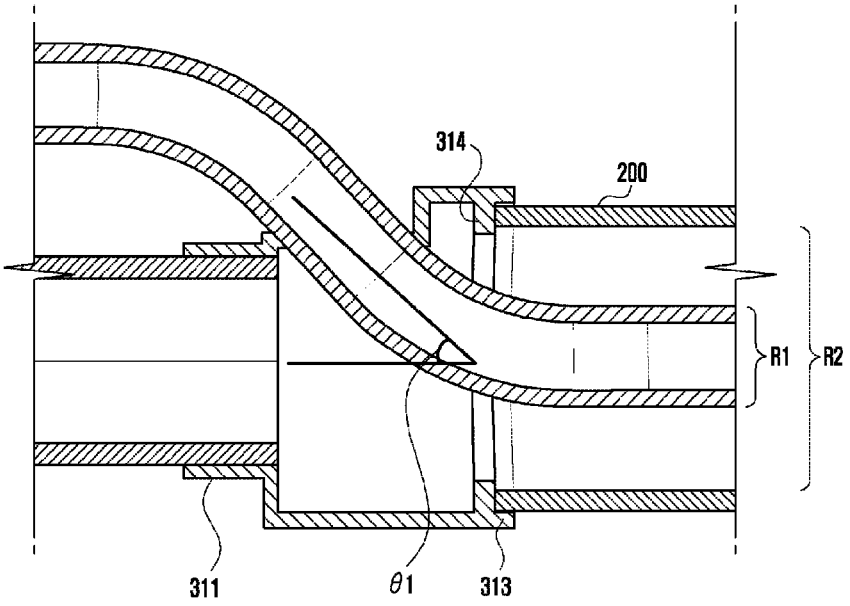
FIG. 3B is a cross-sectional view illustrating a dual pipe for heat exchange according to a first exemplary embodiment of the present invention.

FIG. 2 is a perspective view illustrating a coil type inner pipe 100 according to a first exemplary embodiment of the present invention.

The inner pipe 100 has a coil portion 112, and the coil portion 112 is formed in a spring shape having a virtual circle therein. The coil portion 112 has a shape continuously including adjacent pipes due to a spring shape. The adjacent pipes may contact, but for appropriate heat exchange, it is preferable that adjacent pipes maintain a constant gap. When a distance between the centers of adjacent pipes is L and a diameter of an outer circumferential surface of the inner pipe 100 is R1, it is preferable that the coil portion 112 satisfies $0.5\times R1\leq L$ and it is more preferable that the coil portion 112 satisfies $0.5\times R1\leq L\leq 3\times R1$. Further, when an inner circumferential diameter of the outer pipe 200 is R2, it is preferable that the coil portion 112 satisfies $2\times R1\leq R2\leq 4\times R1$.

Because the inner pipe 100 is formed in a coil shape, when bending exists in a piping portion of a heat exchanger, damage of the inner pipe can be prevented. Even if abnormal bending occurs, danger in which the inner pipe 100 is to be damaged reduces. Further, because a heat exchange area increases due to a coil shape and a fluid flowing to the outer pipe flow channel generates vortex, a heat exchange ability between both fluids is more excellent than that of an existing heat exchanger of a dual pipe.

An outermost portion of the coil portion 112 of the inner pipe 100 generally contacts with an inner circumferential surface of the outer pipe 200. The coil portion 112 of the inner pipe 100 and an inner circumferential surface of the outer pipe 200 contact but do not bond.

The outer pipe 200 is generally a cylindrical straight pipe. The outer pipe 200 may be made of the same material as that of the inner pipe 100, but it is preferable that the outer pipe 200 is made of a heat insulating material for excellent heat exchange. A connector 310 is connected to both end portions of the outer pipe 200. The inner pipe 100 is housed at the inside of the outer pipe 200, and the coil portion 112 of the inner pipe 100 is housed at the inside of the outer pipe 200. A straight pipe portion 111 of the inner pipe 100 is extended to the outside of the outer pipe 200 through both end portions of the outer pipe 200. The straight pipe portion 111 of the inner pipe 100 is further extended to be extended to the outside of the dual pipe through a through hole 312 of the connector 310.

At the connector 310, the inner pipe 100 and the outer pipe 200 are coupled. The connector 310 includes an outer pipe connection portion 313, through hole 312, fastening groove 311.

The outer pipe connection portion 313 is coupled to the outer pipe 200. An outer circumferential surface of an end portion of the outer pipe 200 is inserted into the outer pipe connection portion 313, and an outer circumferential surface of an end portion of the outer pipe 200 and an inner circumferential surface of the outer pipe connection portion 313 contact. In order to prevent separation of the outer pipe 200, a stopper 314 is formed at an inner circumferential surface of the outer pipe connection portion 313, and the stopper 314 generally has a ring shape formed along an inner circumferential surface of the outer pipe connection portion 313. However, the stopper 314 may have a pin shape or an intermittently formed plate shape.

The outer pipe 200 and the connector 310 are connected by a forced insertion method, but may be connected through welding or another fastening device.

The inner pipe 100 is extended to the outside through the through hole 312. The inner pipe 100 is extended from the inside to the outside of the dual pipe, and an inner circumferential surface of the through hole 312 surface contacts with an outer circumferential surface of the inner pipe 100. An inner circumferential surface of the through hole 312 may be formed in a length direction and a vertical direction of the dual pipe, but in a first exemplary embodiment, the inner circumferential surface of the through hole 312 is formed in an inclined direction instead of a vertical direction. An external pipe connection portion of conventional dual pipes was coupled in a length direction of the dual pipe or a direction perpendicular to a length direction of the dual pipe. There was a problem that the dual pipe occupies wide space due to such vertical coupling. In a dual pipe of a first exemplary embodiment, the through hole 312 is formed to have an appropriate angle in a length direction of the dual pipe instead of vertical to a length direction of the dual pipe. It is preferable that a forming angle of the through hole 312 is 30° to 60°. The inner pipe 100 may be bent, and the inner pipe 100 extended to outside through the through hole 312 may be bent parallel to a length direction of the dual pipe. A conventional dual pipe had a problem that should be bent by about 90°, however the present exemplary embodiment has a merit that a volume of the dual pipe reduces with only appropriate bending. For example, when an angle in which an inner circumferential surfaces of the through hole 312 forms with a length direction of the dual pipe is 45°, by bending the inner pipe by 45°, the inner pipe 100 may be parallel to the dual pipe.

The through hole 312 is generally formed in an outer circumferential surface of the connector, but it is preferable that a portion of an outer circumferential surface of the connector is processed in a horizontal surface in a surface shape to be parallel and is processed to position on the horizontal surface 316. An end portion of the horizontal surface 316 is formed toward the fastening groove 311, and the other end portion thereof is formed to contact with the first vertical portion 315. The first vertical portion 315 is formed in an outer circumferential surface direction of the connector 310 from the horizontal surface 316.

An external pipe is coupled to the fastening groove 311 of the dual pipe. A diameter of the fastening groove 311 is smaller than that of the connector 310. In order to constantly make a volume flow quantity of a fluid flowing to the inside of the outer pipe 200, it is preferable that widths that subtract an area of a section of the inner pipe 100 from areas of a section of the external pipe and a section of the outer pipe 200 are similar. Therefore, a diameter of the fastening groove 311 is generally smaller than that of the outer pipe 200. In an end portion of the connector 310, a second vertical portion 317 formed in a constant length in a circle central direction exists, and a protruded portion 318 extended in a length direction of the connector 310 from the second vertical portion 317 exists. An external pipe is connected to a protruded portion 318, and a fluid flowing to the outer pipe flow channel passes through the protruded portion 318 and flows to the external pipe.

Second Exemplary Embodiment

Figure 4A:
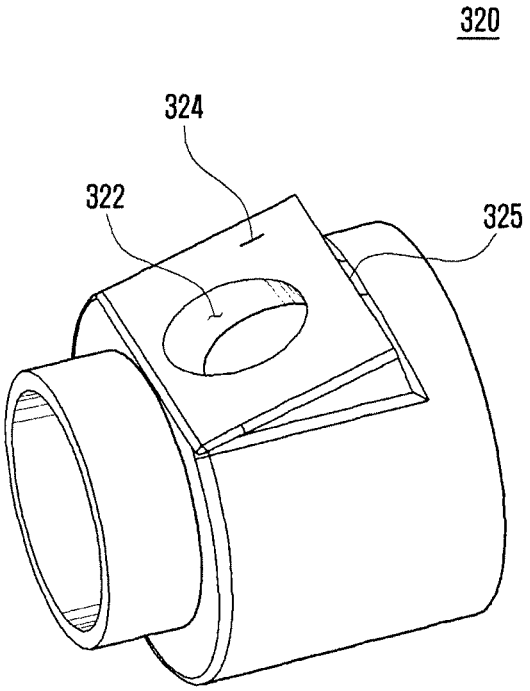
FIG. 4A is a perspective view illustrating a connector according to a second exemplary embodiment of the present invention.
Figure 4B:
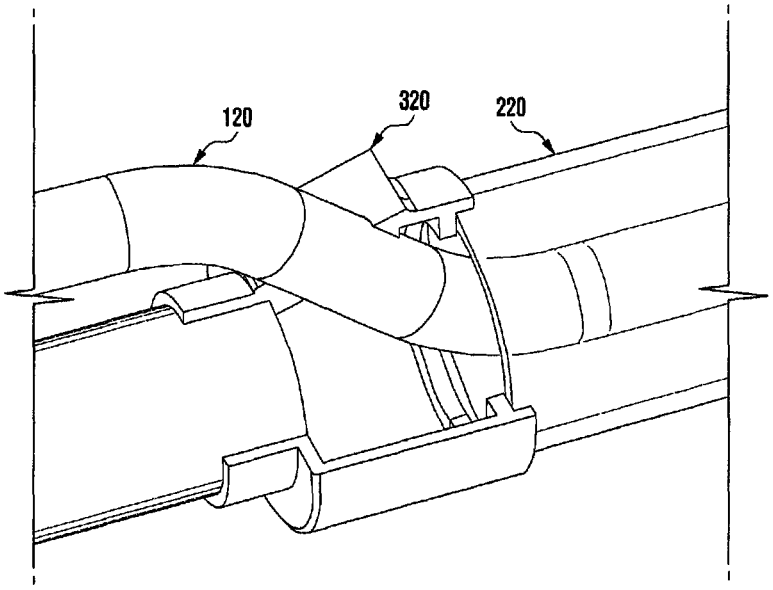
FIG. 4B is a perspective view illustrating coupling of a dual pipe for heat exchange according to a second exemplary embodiment of the present invention.

FIG. 4A is a perspective view illustrating a connector according to a second exemplary embodiment of the present invention, and FIG. 4B is a perspective view illustrating coupling of a dual pipe for heat exchange according to a second exemplary embodiment of the present invention.

The second exemplary embodiment of the present invention includes a modified configuration of a connector. An outer pipe 200 and an inner pipe 100 are the same as those of the first exemplary embodiment. The second exemplary embodiment includes an inclined surface 324 instead of a horizontal surface. One end portion of the inclined surface 324 faces a fastening groove, and the other end portion thereof faces an outer pipe connection portion. An end portion of the inclined surface 324 facing the outer pipe connection portion has a shape protruded to the outside of a connector 320. Because the inclined surface 324 has a shape protruded to the outside of the connector, an inner circumferential surface of a through hole 322 may be formed to have a width greater than that of the first exemplary embodiment. Therefore, a contact area of the inner pipe 100 and the through hole 322 is enlarged, and coupling reliability further improves.

Third Exemplary Embodiment

Figure 5A:
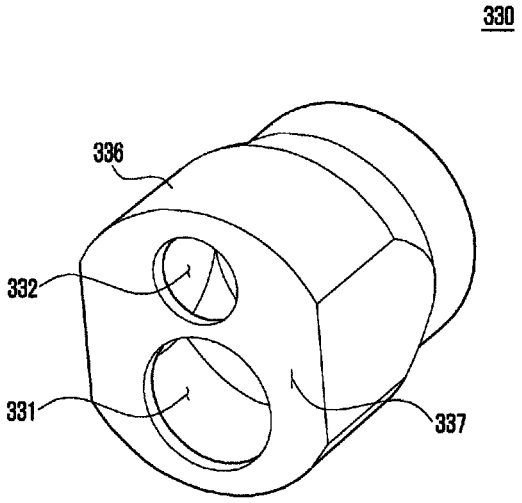
FIG. 5A is a perspective view illustrating a connector according to a third exemplary embodiment of the present invention.
Figure 5B:
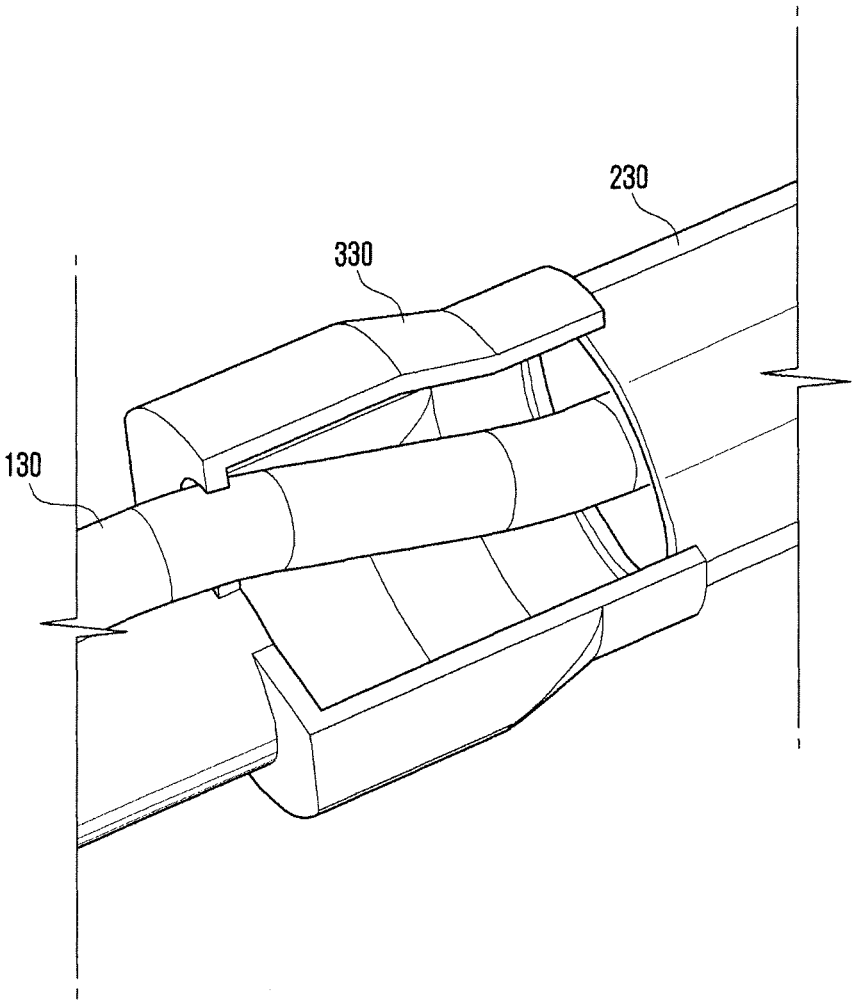
FIG. 5B is a perspective view illustrating coupling of a dual pipe for heat exchange according to a third exemplary embodiment of the present invention.
Figure 5C:
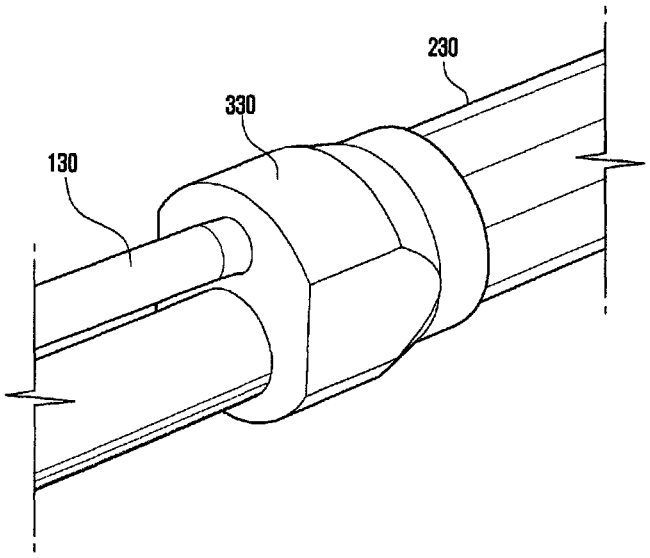
FIG. 5C is a perspective view illustrating coupling of a dual pipe for heat exchange according to a third exemplary embodiment of the present invention.

FIG. 5A is a perspective view illustrating a connector according to a third exemplary embodiment of the present invention, FIG. 5B is a perspective view illustrating coupling of a dual pipe for heat exchange according to a third exemplary embodiment of the present invention, and FIG. 5C is a perspective view illustrating coupling of a dual pipe for heat exchange according to a third exemplary embodiment of the present invention.

The third exemplary embodiment of the present invention includes a modified configuration of a connector. An outer pipe 200 and an inner pipe 100 are the same as those of the first and second exemplary embodiments.

A connector 330 includes a pipe expander 336 enlarged in a direction of a fastening groove 331 from an outer pipe connection portion. The fastening groove 331 is formed on a second vertical portion 337, as in the first and second exemplary embodiments, but a through hole 332 is formed on the second vertical portion 337, unlike the first and second exemplary embodiments. Because the through hole 332 is formed on the second vertical portion 337, after the inner pipe 100 is extended to the outside of the through hole 332, the inner pipe 100 is not bent. Due to such a configuration, there is a merit that the connector 330 can be easily produced and a volume of the dual pipe reduces. Although not shown in FIG. 5A, a protruded portion may exist. In the through hole 332, for easy coupling to the inner pipe 100, it may be considered to form a protruded portion extended from the through hole 332 to the outside.

Fourth Exemplary Embodiment

Figure 6A:
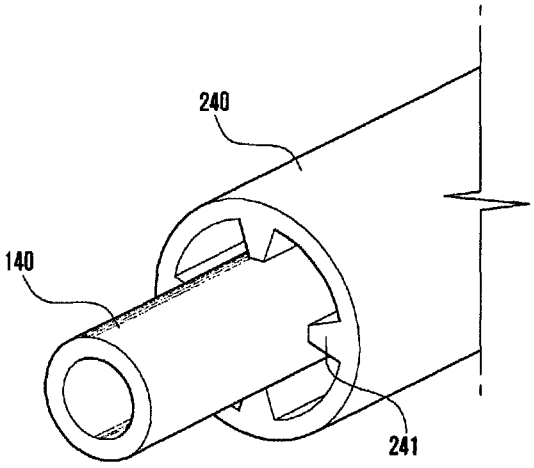
FIGS. 6A and 6B are perspective views illustrating coupling of an inner pipe and an outer pipe according to a fourth exemplary embodiment of the present invention.
Figure 6B:
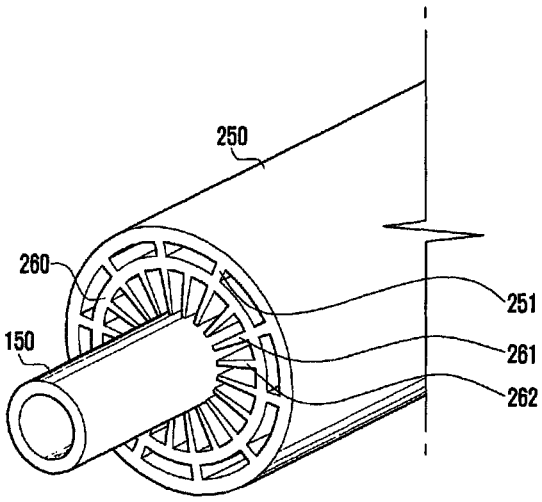

FIGS. 6A and 6B are perspective views illustrating coupling of an inner pipe and an outer pipe according to a fourth exemplary embodiment of the present invention.

The fourth exemplary embodiment of the present invention includes a modified configuration of an outer pipe 240 and an inner pipe 140. The inner pipe 140 has a straight pipe shape instead of a coil shape.

A partitioning wall 241 fanned by protruding from an inner circumferential surface of the outer pipe 240 to an outer circumferential surface direction of the inner pipe 140 exists between the outer pipe 240 and the inner pipe 140. The partitioning wall 241 is extended in a length direction of the outer pipe 240 and is disposed at a predetermined gap in a circumference direction. The partitioning wall 241 is generally formed in a straight line in a length direction of the outer pipe 240, but for appropriate heat exchange, that it is preferable that the partitioning wall 241 is extended in a spiral shape in a length direction of the outer pipe 240.

An outer pipe 250 may have a shape of the dual pipe shown in FIG. 6B. In this case, the heat exchanger becomes a triple pipe heat exchanger. An intermediate pipe 260 added to the inside of the outer pipe 250 is formed integrally with the outer pipe 250. A partitioning wall 251 is formed between the outer pipe 250 and the intermediate pipe 260, and additional partitioning walls 261 and 262 are formed at an inner circumferential surface of the intermediate pipe 260. The first additional partitioning wall 261 is formed at a position corresponding to the partitioning wall 251 formed at an inner circumferential surface of the outer pipe 250. Further, the separate second additional partitioning wall 262 may be formed between the first additional partitioning wall 261.

The outer pipes 240 and 250 and the inner pipes 140 and 150 of the separate dual pipe are separately produced, and by inserting the inner pipes 140 and 150 into the outer pipes 240 and 250 in which the partitioning wall 251 exists, a dual pipe can be produced. The connectors 310, 320, and 330 are inserted into both end portions of such a dual pipe, and the inner pipes 140 and 150 are extended to the outside through the through holes 312, 322, and 332.

As described above, according to the present invention, by improving thermal conductivity of a refrigerant by a structure of a dual pipe, efficiency and performance of an air-conditioner system for a vehicle can be improved.

By a structure of the dual pipe, a thickness of an outer pipe and an inner pipe can be minimized.

By improving heat exchange efficiency by a heat exchanger having a dual pipe, cooling efficiency of a cooling system can be improved.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims.

We claim:

1. A dual pipe for heat exchange, comprising:

an inner pipe haying a coil portion with spaced apart coils and at least one extension portion extending from one end of the coil portion;

an outer pipe having an inner diameter sized to receive at least the coil portion of the inner pipe therein with an exterior surface of the coil portion positioned to line contact an inner circumferential surface of the outer pipe; and a connector coupleable to the inner pipe and the outer pipe, wherein the connector is formed as a single piece and comprises a body, an outer pipe connection portion at one end of the body for receiving an end portion of the outer pipe therein, the outer pipe connection portion comprising a stopper protruding radially inwardly to stop the outer pipe from further insertion into the connector, a fastening portion at another end of the body for fastening a supply pipe of a fluid supplied to a flow path through the connector and between the outer pipe and the inner pipe, the fastening portion having a protruded extension extending axially and shaped to receive an end of the supply pipe and a through hole formed in the body and through which the inner pipe can extend to outside the connector, the through hole having an inner circumferential surface sized to contact an outer circumferential surface of the extension portion of the inner pipe, wherein an outer surface of the connector comprises a planar portion and a radially outward extending surface adjoining the planar portion, and wherein the through hole is formed in the planar portion, one end of the planar portion extends axially to the fastening portion, and an opposite end extends axially to the radially outwardly extending surface.

2. The dual pipe of claim 1, wherein L is a distance between respective centers of adjacent coils, R1 is an outer diameter of the inner pipe, and the coil portion satisfies $0.5\times R1 \leq L \leq 3\times R1$, and wherein R2 is an inner diameter of the outer pipe and the dual pipe further satisfies $2\times R1 \leq R2 \leq 4\times R1$.

3. The dual pipe of claim 1, wherein the inner pipe, outer pipe, and connector are made of the same material.

* * * * *